United States Patent [19]

Anderson et al.

[11] 4,193,346

[45] Mar. 18, 1980

[54] ELECTROLYTIC PRESSURE MECHANISM

[75] Inventors: Alton D. Anderson, Skokie, Ill.; Nelson N. Estes, Silver Spring, Md.

[73] Assignee: The Unites States of America as represented by the Secretary of the Navy, Washington, D.C.

[21] Appl. No.: 342,762

[22] Filed: Mar. 16, 1953

[51] Int. Cl.[2] ..... F42B 21/38; F42B 21/48

[52] U.S. Cl. ..... 102/18 R; 367/149

[58] Field of Search ..... 102/18, 18 R; 340/13, 340/8, 13 E; 73/398; 310/2

[56] References Cited

U.S. PATENT DOCUMENTS

| | | | |
|---|---|---|---|
| 1,461,056 | 7/1923 | Walker | 367/149 |
| 2,353,920 | 7/1944 | Muzzey | 367/178 |
| 2,615,940 | 10/1952 | Williams | 310/300 |
| 2,661,430 | 12/1953 | Hardway | 310/300 |

*Primary Examiner*—Theodore M. Blum

*Attorney, Agent, or Firm*—R. S. Sciascia; A. L. Branning

EXEMPLARY CLAIM

1. A vessel detecting apparatus comprising means responsive to the time varying negative pressure signal produced by the passage of a vessel in proximity to the detecting apparatus for producing an electrical signal having a time varying amplitude correlative with the square root of pressure signal, means for integrating said electrical signal over the interval of the negative pressure signal duration, and utilization means responsive to the time integral of said electrical signal.

18 Claims, 3 Drawing Figures

ELECTROLYTIC PRESSURE MECHANISM

The invention described herein may be manufactured and used by or for the Government of the United States of America for governmental purposes without the payment of any royalties thereon or therefor.

This invention relates to an electrolytic pressure sensitive mechanism, and more particularly pertains to a mine firing mechanism responsive to the negative pressure signal produced by the passage of a vessel in proximity to the mine.

In general, when an electric current passes through an electrolytic cell, there is developed at the electrodes of the cell, a back or counter electromotive force due to polarization. Even in the case where the electrolyte, as a whole, suffers no change in electrolyte concentration, a counter e.m.f. of polarization is produced in consequence of the difference in concentration of ions in the neighborhood of the anode and cathode. This counter e.m.f. causes a decrease in the strength of the current through the cell, the residual current depending upon the rate at which the ions diffuse through the cell. Movement of the electrolyte relative to the electrodes reduces the ion concentration between the electrodes and the resulting polarization, and consequently varies the current flow through the cell.

It has heretofore been proposed to utilize this phenomenon in the measurement of pressure signals, the electrolyte being contained in a housing having a diaphragm and in such a manner that variations in pressure on the diaphragm produce movement of the electrolyte relative to the electrodes.

The instant invention also utilizes the above mentioned phenomenon. However, in order to provide a satisfactory pressure sensitive mine firing mechanism, the latter must have adequate sensitivity within the damage radius of the mine, and also be resistant to premature firing due to wave action. It has been theoretically determined and experimentally verified that at ship speeds low enough so that associated wave effects are negligible, that is at ship speeds below 20 to 25 knots, the function $\Delta P/V^2$ is substantially constant where V is the ship's velocity and $\Delta P$ describes the negative half-cycle pressure change. Hence, the square root of the negative pressure signal $\Delta P$ is directly proportional to V; furthermore, the interval duration of the negative half-cycle signal is inversely proportional to V. Consequently, the definite integral of the square root of the pressure signal over the interval of the negative half-cycle signal duration is, within the above limitations, approximately constant for dimensionally congruent ships passing a specified distance from the point of measurement.

Within the accuracy of reproduction of the pressure signals, certain ships such as submarines are dimensionally alike. From the analysis of pressure signal data values for $$\int_0^T \sqrt{\Delta P}\, dt,$$

where T is the negative half-cycle signal duration given by dimensionally congruent ships, can be determined as a function of the distance from the point of measurement. The mine mechanism of the instant invention measures $$\int_0^T \sqrt{\Delta P}\, dt$$

and has adjustable firing sensitivity so that the mechanism can be set for actuation when the integral reaches the value that exists at the distance from the point of measurement corresponding to the damage radius of the mine.

Premature firing caused by wave action during stormy weather is avoided by automatically adjusting the sensitivity of the mine firing mechanism so that the sensitivity is an inverse function of the background conditions. This is achieved by producing a function whose value is proportional to an average of the background signals that have been measured over a prolonged preceeding time period, and by comparing each of the individual integrals with this average. Therefore, a second requirement for actuation of the mine firing mechanism is that the individual values of $$\int_0^T \sqrt{\Delta P}\, dt$$

must exceed the average by an amount greater than the expected deviation of individual wave signals from the average.

The instant invention utilizes the aforementioned electro-chemical process to continuously measure, as a function of time, the square root of the pressure differential in negative deviations from the static head; integrate this function with respect to time; and compare the maximum value of each integral with a function proportional to the average background negative deviations. A hydraulic system is utilized to balance out the static head whereby the differential pressure variations are separated from the static pressures.

An important object of this invention is to provide a pressure sensitive mine which will detect the low-frequency signal produced by the passage of a vessel within the damage radius of the mine.

Another object of this invention is to provide a mine firing apparatus of adjustable sensitivity which is actuated only by dimensionally congruent ships passing within a predetermined distance of the mine.

Another object of this invention is to provide a pressure sensitive mine, in accordance with the foregoing object, which is resistant to premature firing due to wave action.

Another object of this invention is to provide a pressure sensitive mine, in accordance with the foregoing object, in which the static-head is balanced out whereby only the differential pressures are caused to appear across the low-frequency pressure signal detecting device.

Still another object of this invention is to provide a pressure sensitive device which continually measures, as a function of time, the square root of the pressure differentials in negative deviations from the static-head, to thereby provide a signal correlative with the velocity of the vessel.

A further object of this invention is to provide a pressure sensitive device, in accordance with the foregoing object, which integrates, with respect to time, the square root of the pressure differential in negative deviations of the static-head.

Yet, another object of this invention is to provide a pressure sensitive device which will compare the maximum value of each integral with a function proportional with the average background negative deviations.

Still another object of this invention is to provide a pressure sensitive device in accordance with the foregoing objects which have low power requirements.

Other objects and many of the attendant advantages of this invention will be readily appreciated as the same becomes better understood by reference to the following detailed description when considered in connection with the accompanying drawings wherein.

The instant invention utilizes a self-regenerating electrolytic cell to continuously measure, as a function of time, the square root of the pressure differentials in negative deviations from the static head; to integrate this function with respect to time; and compare the maximum value of each integral with a function proportional to the average background negative deviations. Various different electrolytes may be utilized, it being preferred to employ an electrolyte of the type in which only a single electro-chemical reaction occurs in opposite directions at the anode and cathode.

One suitable electrolyte is iodine in a solution containing potassium iodide, the electrodes being formed of a material such as platinum which is not attacked by iodine. The electro-chemical reaction utilized is:

$$I_3^- + 2e \rightleftarrows 3I_1^- \quad (1)$$

in which iodine in the solution containing potassium iodide, is changed from $I_3^-$ ion to $3I_1^-$ ion at the cathode within the solution while the inverse occurs at the anode within the solution.

The current will remain independent of the potential difference between electrodes provided the applied voltage is maintained low enough so that $I_3^-$ ion is the only ion entering the reaction. It has been experimentally observed that an increase in current at between 0.5 and 0.9 volts occurs when the solution contains dissolved oxygen. If the oxygen is excluded from the solution, the constant current range extends to about 1.35 volts. Above about 1.4 volts hydrogen is found at the electrodes and consequently it is desirable to limit the applied potential to a range of below 1.4 volts and above about 0.4 volts for an electrolyte consisting of iodine in a solution of potassium iodide. The operating potentials will, of course, be different if different electrolytes are used.

Over this voltage range, the rate of the reaction, and hence the current that flows between the anode and cathode, is determined only by the rate at which $I_3^-$ ions reach the cathode. The physical forces motivating the $I_3^-$ ions are thermal agitation which produces a current proportional to temperature at constant concentration, and proportional to concentration at constant temperature; convection, an insignificant force if no temperature gradients are permitted to exist within the solution; and mechanical motivation produced by application of external forces.

Figure 1:
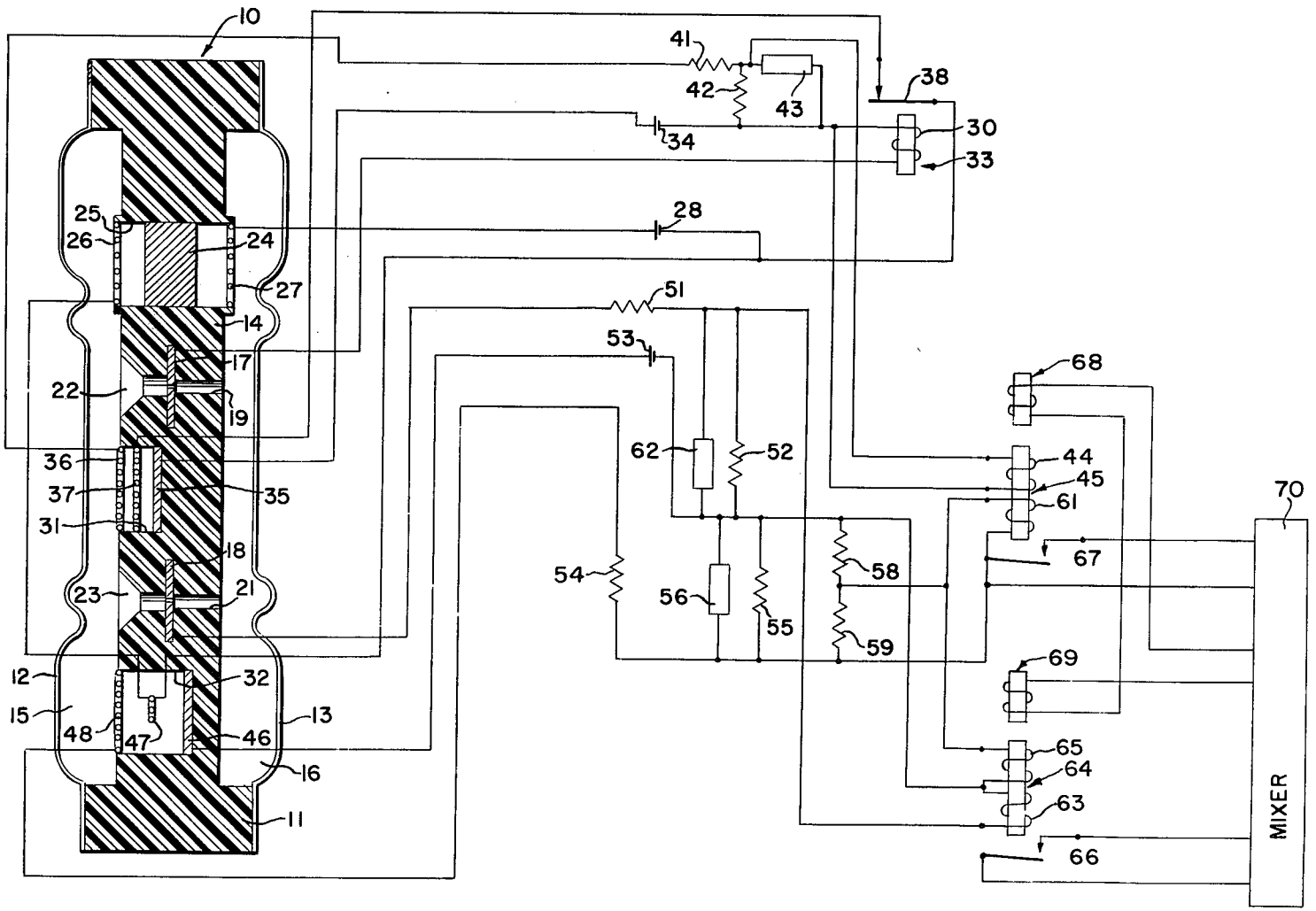
FIG. 1 is a schematic diagram of the electrolytic pressure sensitive mechanism.

Reference is now made more specifically to FIG. 1 of the drawing. The pressure sensitive detector 10 comprises a housing having a rigid peripheral wall 11 and flexible diaphragms 12 and 13 secured to the opposite ends thereof. A rigid divider wall 14 is secured to the wall 11 between the diaphragms 12 and 13 and divides the housing into chambers 15 and 16, of approximately equal volumes, which chambers are filled with an electrolyte such as iodine in a solution of potassium iodide.

A pair of orifice plate cathodes 17 and 18, hereinafter referred to as the individual cathode and average cathode respectively, are mounted in the divider wall 14. The dimensions of the cathode orifices are empirically chosen so as to provide a current proportional to the square root of the pressure differential existing across the cathode. The orifice cathodes should be insulated on the side presented to the chamber of high concentration $I_3^-$ in order to keep the contribution of this face of the orifice cathodes to the background current to a minimum. This may be achieved by either coating the faces of the orifice cathodes which are presented to the chamber of high ion concentration with an insulating material, or by providing constricted passages such as 19 and 21 in the divider wall 14, which passages respectively communicate the orifice plate cathodes 17 and 18 with the chamber 16 of high $I_3^-$ ion concentration. The other side of the orifice cathodes communicate with the chamber 15 of low $I_3^-$ ion concentration through passages 22 and 23 which open rapidly into a large cross sectional area so as to thereby keep the ohmic resistance of the solution low enough so that it will not appreciably affect the currents from the orifice cathodes.

Although the cathode orifices are designed to produce an output current proportional to the square root of the pressure differential, the maximum current which can flow is limited by the absolute ohmic resistance of the solution. Consequently as the output current approaches its limiting value, the response function changes becoming asymptotic to this limiting value. However, the ohmic resistance of the solution is variable as function of the salt concentration of the solution, in this case potassium iodide. Other salts may be added to the solution provided they do not present an ion which will cause a side reaction within the working voltage range.

For low temperature applications, the solute is preferrably one having a low freezing point such as methyl alcohol.

The pressure differentials applied across the detector 10 causes the solution to flow past the orifice cathodes. In order to achieve response to only negative pressure differentials, the solutions contained in the chamber 15 and 16 are maintained at different $I_3^-$ ion concentration. This is achieved by the provision of a porous filter 24 in an opening 25 in the divider wall 14 and a pair of electrodes 26 and 27 disposed in the chambers 15 and 16 respectively. The electrodes 26 and 27 hereinafter referred to as the main cell cathode and anode respectively may be formed of a wire mesh of a material such as platinum which is not attacked by the electrolytic solution. The anode 27 and cathode 26 are respectively electrically connected to the positive and negative terminals of the main cell battery 28 whereby an ion current passes between the chambers 15 and 16 through the porous filter. As is apparent from equation (1) supra, the iodine in the solution of potassium iodide is changed from the $I_3^-$ ion to $I_1^-$ ions at the cathode while the $I_1^-$ ions are changed to the $I_3^-$ ion at the anode. Consequently, chamber 16 is high in $I_3^-$ ion concentration while chamber 15 is low in $I_3^-$ ion concentration.

Each orifice plate is a cathode with respect to an anode situated within a small cell. For this purpose, a pair of compartments 31 and 32 are formed in the divider wall 14 and communicate with the chamber 15 of low $I_3^-$ ion concentration. The individual cathode 17 is connected through winding 30 of relay 33 to the negative side of battery 34, the positive side of which battery is connected to the anode 35 in the individual integrator cell. The individual integrator cell includes, in addition to the anode 35, a cathode 36 and a sweep electrode 37. The cathode 36 and sweep electrode 37 are preferably formed of a metallic mesh such as platinum which is not attacked by the electrolyte, the cathode being positioned so as to effectively cover the opening of the compartment 31. The sweep electrode 37 is electrically connected through the normally closed switch 38 of relay 33 to the negative side of battery 28, which battery, as hereinbefore set forth, has its positive side connected to the main cell anode 27. The cathode 36 is connected through resistors 41 and 42 to the negative side of battery 34, the positive side of which battery is connected to the anode 35, as set forth previously. A negative temperature coefficient resistor 43 or Thermistor is connected in shunt with resistor 42 to compensate for the variation in the diffusion of the $I_3^-$ ion in the electrolyte with temperature. The winding 44 of the differential firing relay 45 is connected in parallel with the Thermistor 43 and resistor 42 whereby winding 44 is variably shunted in accordance with temperature variations to thereby compensate for the variations in diffusion.

When a negative pressure signal is applied across the pressure sensitive device, $I_3^-$ ions from chamber 16 flow past the individual orifice cathode 17 where the $I_3^-$ ions are changed to $I_1^-$ ions thereby causing a current to flow through the winding 30 on relay 33, through battery 34 to the individual cell anode 35. $I_3^-$ ions are generated at the individual cell 31 at a rate proportional to the current flow between cathode 17 and anode 35. The current flowing through the winding of relay 33 opens switch 38 thereby disconnecting the sweep electrode 37. Since the cathode 36 effectively covers the opening of the cell, the $I_3^-$ ions that are generated at the anode 35 in the cell are kept within the cell. The $I_3^-$ concentration of the cell therefore increases at a rate proportional to the current from the orifice plate cathode 17, and the total concentration is proportional to the integral of the current from the orifice plate cathode 17. When the current from the orifice plate cathode returns to or near zero, that is when the negative pressure differential returns to zero, no further $I_3^-$ ions are added to the cell and the switch 38 returns to its normally closed position thereby connecting the sweep electrode 37 as a cathode with respect to the main anode 27. The sweep electrode then removes $I_3^-$ ions from the cell and hence decreases the concentration at a rate that varies with the concentration of the cell.

The rate of diffusion of the ions through the cell from the anode 35 to the cathode 36 is proportional to the $I_3^-$ ion concentration and also proportional to the temperature of the electrolyte. Consequently, the current which flows through the anode-cathode circuit, through resistors 41, 42 and battery 34 is proportional to both the $I_3^-$ ion concentration and temperature of the electrolyte in the individual integrator cells. The Thermistor 43 and resistor 42 provide a temperature variable shunt across winding 44 of relay 45 and thus compensates for the changes in electrolyte conductivity with temperature whereby the current which flows through the winding 44 is proportional only to the changes in conductivity of the cell produced by changes in $I_3^-$ ion concentration therein.

The compartment 32 which is relatively larger than the compartment 31 is provided in the divider wall 14 which compartment together with an anode 46, a sweep electrode 47 and a cathode 48 forms an average integrator cell. The average integrator cell differs from the individual integrator cell principally in that its volume is larger and its sweep electrode smaller in area. Hence the response of the average integrator cell is slower both in increasing concentration and in sweeping. The sweep electrode 47 is continuously connected as a cathode with respect to the main anode 27 across battery 28 and consequently its sweeping rate is proportional to the concentration of the cell.

The average orifice cathode 18 is electrically connected through resistors 51 and 52 and battery 53 to the average cell anode 46, and the average cell cathode 48 is connected through resistors 54 and 55 and battery 53 to the anode 46. A Thermistor 56 is connected in shunt with resistor 55 to compensate for the variations in conductivity of the average integrator cell with varying temperatures. A voltage divider including resistors 58 and 59 is connected in parallel with resistor 55 and Thermistor 56, and a second winding 61 on the differential relay 45 is connected in parallel with resistor 59. Winding 61 is thus variably shunted in accordance with temperature variations whereby the current which flows through winding 61 is proportional to the $I_3^-$ ion concentration in the average integrator cell and independent of temperature variations in the electrolyte.

Resistor 52 is also shunted by a temperature compensating Thermistor 62. One winding 63 of differential relay 64 is connected in parallel with resistor 52 and Thermistor 62. Thus the current flow through winding 63 is proportional to the current flow between average orifice cathode 18 and the average cell anode 46 and independent of temperature variations in the electrolyte.

The other winding 65 of relay 64 is connected in parallel with resistor 58 whereby the current flow through winding 65 is proportional to the average cell $I_3^-$ ion concentration and independent of temperature changes in the electrolyte.

The relay 64 is chosen such that the normally open switch 66 is urged to its closed position only when the current flow through winding 63 exceeds the current flow through winding 65 by an amount determined by parameters of the circuits for energizing the respective windings. Since the energization of winding 63 is controlled by the current flow between the average cell orifice cathode 18 and the average cell anode 46 and the energization of winding 65 is controlled by current flow between average cell anode 46 and the average cell cathode 48, the switch 66 which controls operation of a conventional mixer is closed only when the individual negative pressure differentials exceed the average by a predetermined amount.

The differential firing relay 45 is chosen such that the normally open switch 67 is urged to its closed position when the current flow through winding 44 exceeds the current flow through winding 61 by a predetermined amount. As hereinbefore set forth, the winding 44 is energized by a signal proportional to the $I_3^-$ ion concentration in the individual integrator cell, which concentration is proportional to the time integral of the individual negative pressure signals applied to the pressure sensitive mechanism. The winding 61 is energized by a signal proportional to the $I_3^-$ ion concentration in the average integrator cell which ion concentration is proportional to the average of the negative pressure signals applied across the pressure sensitive device. When the individual integrator current exceeds the average integrator current by an amount determined by the resistances of the respective circuits, the normally open switch 67 of the firing relay 45 closes.

When a continuous train of waves is applied to the pressure sensitive mechanism, $I_3^-$ ions flow from compartment 16 through the orifice cathodes 17 and 18 during each negative half cycle and add a certain quantity of $I_3^-$ ions to the respective cells 31 and 32. The volume of the individual cell 31 is made small and the area of the sweep electrode 37 large so that sweeping of the individual integrator cell, which is effected only during positive pressure periods, removes as large portion of the $I_3^-$ ions in the cell as is practical. However, if the positive periods are too short to permit complete sweeping, the concentration in the cell will build up until the sweep rate which is proportional to concentration equals the rate that $I_3^-$ ions are introduced into the cell from the orifice cathode 17. Because the sweep rate of the individual integrator cell is purposely made high, the increase in $I_3^-$ ion concentration of the individual cell during each negative pressure period is large as compared to the background concentration.

In the average integrator cell 32 the volume is relatively larger and the sweep electrode area relatively smaller than that of the individual cell and the average cell sweep electrode is continuously connected so as to remove $I_3^-$ ions at a rate dependent on the $I_3^-$ ion concentration in the cell. When the $I_3^-$ in concentration in the average cell reaches a value such that the $I_3^-$ ions removed during the entire cycle equals the amount added during the negative half cycle, equilibrium of concentration is achieved. Because of the low sweep electrode area, the large volume of the cell, and the continuous connection of the sweep electrode, increases in $I_3^-$ ion concentration of the average cell during negative pressure periods are small as compared to the average or equilibrium concentration.

Since the output currents from the individual and average integrator cells are compared in the differential relay 45 it is deemed apparent that switch 67 is closed only when the individual pressure signals exceed the average by a predetermined amount. Thus, the sensitivity of the mine is made an inverse function of the background waves.

The mixer 70 controlled by the relays 45 and 64 may be of any conventional type such as are commonly utilized in mine firing circuits. The relay 64 is provided to initiate operation of the mixer when the individual pressure signal differs from the background or average, the relay 45 controlling the firing circuit of the mine. Obviously, other means may be provided to initiate operation of the mixer. Reset relays 68 and 69 are provided to reopen switches 66 and 67. Energization of the reset relays is controlled by the mixer 70 whereby the switches 66 and 67 are reopened in response to a falsifying signal from the mixer.

Figure 2:
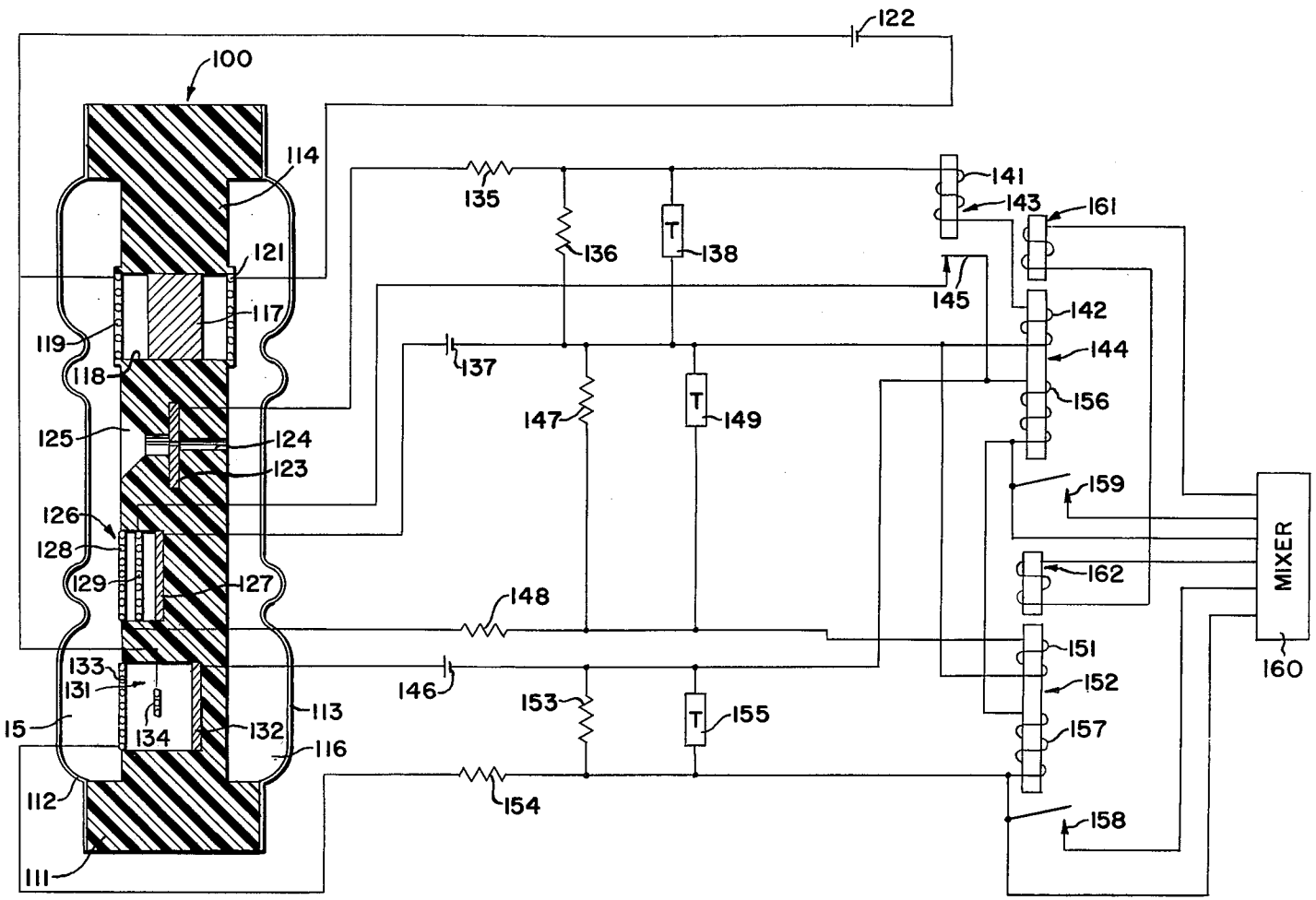
FIG. 2 is a schematic diagram of a modified form of electrolytic pressure sensitive mechanism.
Figure 3:
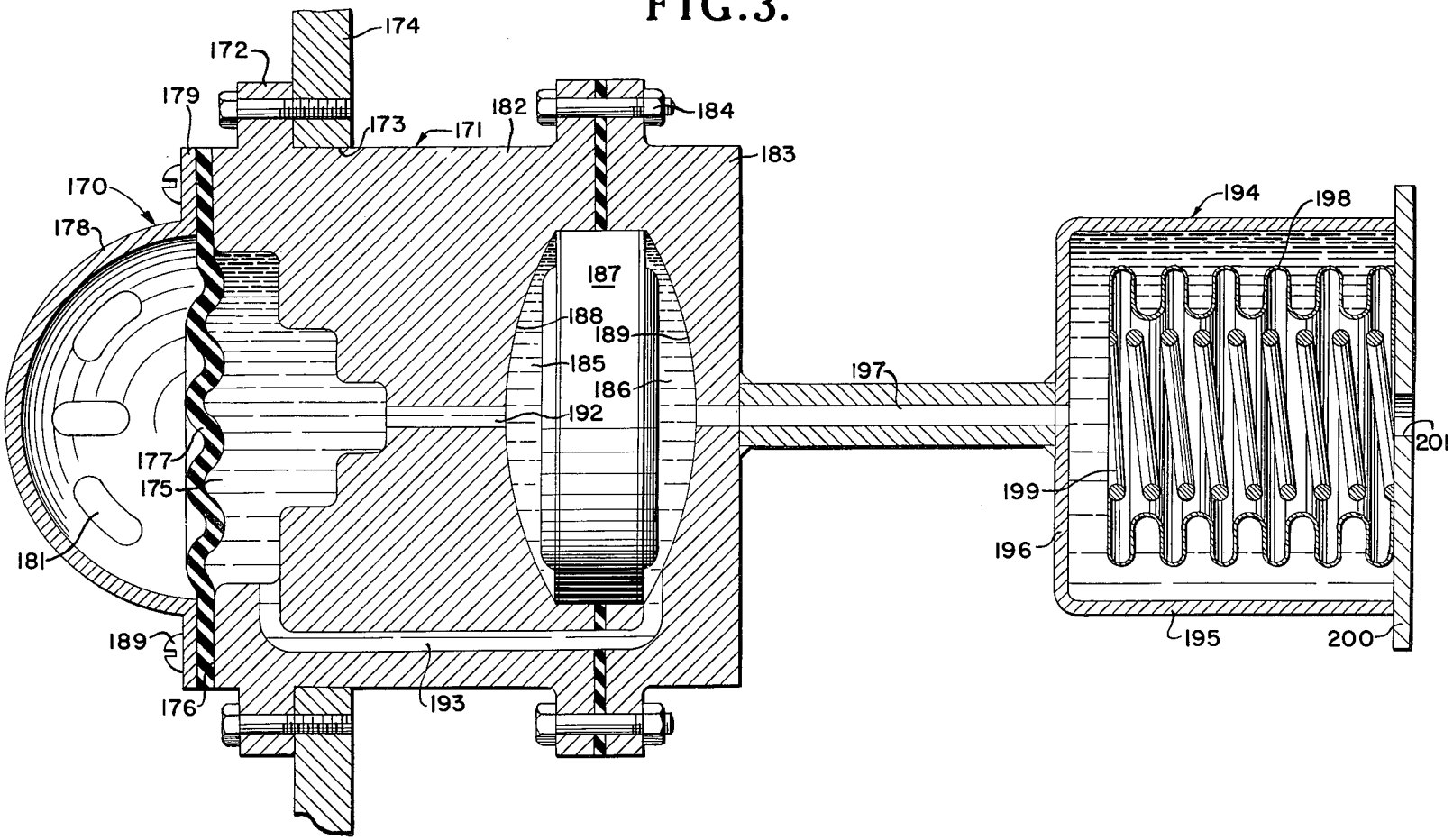
FIG. 3 is a schematic diagram of a hydraulic system for separating the static pressure from the differential pressure variations.

Reference is now made more specifically to the modified form of the invention illustrated in FIG. 2. As in the preceeding embodiment, the pressure sensitive device 100 includes a peripheral wall 111, a pair of flexible diaphragms 112 and 113 secured to opposite ends thereof and a divider wall 114 disposed between the diaphragms and dividing the pressure sensitive device into chambers 115 and 116 of substantially equal volumes. The device 100 is filled with an electrolyte such as iodine in a solution of potassium iodide.

An ion concentration gradient is maintained between the chambers by the porous filter plug 117 in an opening 118 in the divider wall 114, and by a main cell cathode 119 and a main cell anode 121 in the chambers 115 and 116 respectively. A battery 122 is connected to the main cell anode and cathode whereby the iodine in the solution containing potassium iodide is changed from $I_3^-$ ion to $I_1^-$ ion at the cathode while the inverse reaction occurs at the anode within the solution. An orifice cathode 123 is mounted in the divider wall 114 and communicates through the constricted passage 124 with the chamber 116 of high $I_3^-$ ion concentration and communicates by way of flaring passage 125 with the chamber 115 of low $I_3^-$ ion concentration.

An individual integrator cell 126 is formed in the divider wall 114 and communicates with the chamber 115 of low $I_3^-$ ion concentration, the individual integrator cell including an anode 127, a cathode 128 and a sweep electrode 129. The average integrator cell 131 of relatively larger volume than the individual integrator cell also communicates with chamber 115. The average integrator cell includes an anode 132, a cathode 133 and a sweep electrode 134 of an area relatively smaller than that of the individual cell sweep electrode 129. As in the preceeding embodiment, the anodes, cathodes, sweep electrodes and orifice are formed of an electrically conductive material such as platinum which is not attacked by the electrolyte.

The orifice cathode 123 is connected as a cathode with respect to the individual cell anode 127 through resistors 135 and 136 and battery 137. A Thermistor 138 is connected in shunt with resistor 136 to compensate for the variations in conductivity of the electrolyte due to temperature variations. Series connected windings 141 and 142 of relays 143 and 144 respectively are connected in parallel with resistor 136 and Thermistor 138. The individual cell sweep electrode 129 is connected as a cathode with respect to the average cell anode 132 through normally closed switch 145 of relay 143 and battery 146. Individual cell anode 127 is connected through battery 137 and resistors 147 and 148 to the individual cell cathode 128, Thermistor 149 being connected in shunt with resistor 147 to compensate for variations in conductivity of the individual integrator cell with variations in temperature of the electrolyte. Winding 151 of differential relay 152 is connected in parallel with resistor 147 and Thermistor 149. The average cell sweep electrode 134 having a relatively smaller area than the individual cell sweep electrode is continuously connected as a cathode with respect to the main cell anode 121 through battery 122 and the average cell anode 132 is connected through battery 146, resistors 153 and 154 to the average cell cathode. A Thermistor 155 is shunted across resistor 153 to compensate for variations in conductivity of the average integrator cell with variations in temperature of the electrolyte, and series connected winding 156 and 157 on differential relays 144 and 152 respectively are connected in parallel with resistor 153 and Thermistor 155.

Relay 144 controls a normally open switch 159 which, upon closure, initiates operation of a mixer 160 as in the preceeding embodiment, relay 152 controlling a normally open switch 158 in the mine firing circuit. Reset relays 161 and 162 are provided to reopen switches 159 and 158 respectively. Energization of the reset relays is controlled by the mixer 160 whereby switches 158 and 159 are reopened in response to a falsifying signal from the mixer.

When a negative pressure differential is applied across the pressure sensitive device 100, $I_3^-$ ions from chamber 116 flow past the orifice cathode 123 where the $I_3^-$ ions are changed to $I_1^-$ ions causing a current flow through the external circuit including resistors 135, 136 and battery 137 whereby $I_3^-$ ions are generated at the anode 127 within the individual integrator cell at a rate proportional to $I_3^-$ ion flow past cathode orifice 123. As in the preceeding embodiment, the cathode 123 is designed so as to afford an output current correlative with the square root of the pressure differential across the pressure sensitive device. The voltage across resistor 136 is applied to windings 141 and 142 whereby switch 145 is opened, thus disconnecting the individual cell sweep electrode and switch 159 is urged to its closed position provided the individual negative pressure signal exceeds the background by a predetermined amount determined by the parameters of the circuits for energizing windings 142 and 156. A signal proportional to the background is applied to winding 156 of differential relay 144 in a manner more fully described hereinafter.

During positive pressure periods, current flow between anode 127 and orifice cathode 123 ceases and switch 145 closes thereby connecting the individual cell sweep electrode 129 as a cathode with respect to the average integrator cell anode 132 and thus decreasing the $I_3^-$ ion concentration in the individual cell 126 at a rate proportional to concentration in the cell and correspondingly increasing the $I_3^-$ ion concentration in the average integrator cell 131.

Current flow from anode 127 to cathode 128 of the individual integrator cell is proportional to the $I_3^-$ ion concentration, at constant temperatures and since the $I_3^-$ ion concentration in the individual cell during negative pressure periods increases at a rate proportional to the $I_3^-$ ion flow past orifice cathode 123, the current flow through the individual integrator cell is proportional to the time integral of the $I_3^-$ ion flow past the orifice cathode. Winding 151 of differential firing relay 152 is energized in proportion to the current flow through the individual integrator cell.

If the train of waves is applied to the device 100 whose positive periods are too short to permit complete sweeping of the individual integrator cell, then there will be a residual $I_3^-$ ion concentration in the individual cell. Since the rate of sweeping is proportional to $I_3^-$ ion concentration, the residual concentration of the individual cell will build up until the rate of sweeping equals the rate at which $I_3^-$ ions are added during each negative pressure period. Under these conditions, substantially all of the $I_3^-$ ions added to the individual integrator cell during each negative pressure period will be transferred to the average integrator cell during the positive pressure periods. Thus, the total quantity of $I_3^-$ ions sent to the average integrator is, on the average, the same as in the first embodiment, the main difference being that the $I_3^-$ ions flowing past the orifice cathode are first utilized in the individual cell and then transferred to the average integrator cell.

The sweep electrode in the average integrator cell is continuously connected as a cathode with respect to the main anode 121 whereby the $I_3^-$ ions are continuously removed from the average cell. However, the volume of the average cell is larger than the individual cell and the sweep electrode of the average cell is of relatively smaller area than the sweep electrode of the individual cell whereby the sweeping rate is much slower and the $I_3^-$ ion concentration of the cell builds up until the sweep rate equals the rate at which $I_3^{31}$ ions are added to the cell. Because of the relatively large volume of the average cell, individual increments in the ion concentration have little effect on the average concentration of the cell so that a substantially steady current will flow between the average cell anode and the average cell cathode correlative with the magnitude of the background pressure signals.

Winding 156 on differential relay 144 and winding 157 on relay 152 are energized by a current proportional to the steady state current through the average integrator cell. Thus, only when the individual negative pressure signal exceeds the average of the background signals is switch 159 closed thereby initiating operation of the mixer. The signal applied to winding 151 includes a steady state component proportional to the average of the background pressure differentials and a component proportional to the integral of the individual negative pressure differentials. Relay 152 compares the signal correlative with the individual cell current with a signal correlative with the average cell current and effects closure of switch 158 only when a predetermined differential exists between the signals correlative with the individual cell current and the average cell current.

Reference is now made more specifically to the hydraulic system for balancing out the static head; for discriminating against the pressure differentials caused by tidal variations, which differentials are of relatively lower frequency than the frequency range of a ship's signatures, and also discriminate against countermine shock component frequencies which are of relatively higher frequency than the frequency range of ship's signatures.

The hydraulic system 170 includes a rigid housing 171 having flanges 172 thereon whereby the housing is adapted for attachment in an opening 173 in the wall 174 of a mine casing, or the like. A stepped recess 175 is formed in one end 176 of the housing 171 and a flexible diaphragm 177 is attached to the end 176 of the housing across the recess 175. A dome shaped head 178 has the flanged rim 179 thereof secured to the end 176 of the housing as by fasteners 180 to prevent damage to the diaphragm. Apertures 181 are provided in the head 178 whereby the diaphragm is in communication with the surrounding medium such as the sea.

The housing 171 includes sections 182 and 183, which sections are fastened together as by fasteners 184. Recesses 185 and 186 are formed in the adjacent faces of sections 182 and 183 respectively, which recesses are shaped so that the pressure sensitive detector 187 has the peripheral wall thereof immovably supported by the housing in fluid sealing engagement therewith. The walls of the recesses 185 and 186 are dished as at 188 and 189 whereby the diaphragms of the pressure sensitive detector are freely movable within the recesses. A fluid impedance passage 192 affords communication between recess 175 and recess 185, a fluid impedance passage 193 being provided to afford communication between recess 175 and recess 186.

Recess 186 communicates with a back-volume 194 by way of a fluid impedance line 197. The back-volume consists of a housing having a side wall 195 and an end wall 196 with a bellows 198 disposed in the housing and having its open end secured to the housing as by a plate 200. A spring 199 is disposed within the bellows 198 and engages the plate 200 whereby the bellows is normally urged into its expanded position. An opening 201 is provided in the plate 200 whereby the air contained in the bellows may be exhausted as the bellows is compressed.

The hydraulic system is preferably designed so that when the mine mechanism is exposed to a static pressure head of between 10 feet and 150 feet of water, the diaphragm 177 is deflected inwardly. Since the system is fluid filled, the fluid displaced by the diaphragm 177 flows through passages 192 and 193 causing the diaphragms of the pressure sensitive device 187 to be deflected inwardly. The fluid also flows through passage 193, recess 186, through conduit 197 to the back-volume 194 thereby compressing the bellows 198 against its spring until the static pressure throughout the hydraulic system is equalized. At this time, the diaphragms of the pressure sensitive device 187 will slowly return to their normal positions.

Passage 193 is provided as a tidal by pass, the passage being designed so as to afford negligible impedance to signals of tidal frequency and to afford an appreciable impedance to signal of the frequency corresponding to the pressure signature of a vessel. Passage 192 is designed so as to afford a low impedance to pressure signals of a frequency corresponding to ship pressure signatures and below. Thus, a pressure signal of the frequency of a ship signature produces a measurable pressure differential across the pressure sensitive device 187 whereas tidal variations are passed by both passages 192 and 193 so that the pressure on both diaphragms of the sensitive device 187 is nearly equal and opposite producing negligible resultant deflection of those diaphragms since the sensitive device is fluid filled.

Because of structural limitations, the inductive component of the hydraulic impedance of passage 193 cannot be made large enough with respect to its resistive component to be effective at the frequency of a ship signature and the pressure drop across passage 193, at those frequencies, is due primarily to the fluid resistance of the line.

When slowly varying pressure such as caused by tidal variations is applied to the system, fluid passes through passage 193 at a rate too slow to develop a sensible pressure difference across the passage. Hence, little differential pressure will be developed across the electrolyte pressure sensitive device 10 and no changes will be registered by it. If the pressure changes somewhat more rapidly, as in the case of pressure variations caused by ships, the fluid passing through impedance line 193 will develop an appreciable differential pressure thereacross and hence across the pressure sensitive device 187. When the pressure changes vary rapidly, as in the case of a countermine explosion, the hydraulic resistance to the flow of the fluid in tubes 192 and 193 will be so high that very little fluid will flow through them. The forces of the shock must then be borne by the walls of the hydraulic system.

In order that the hydraulic system be capable of withstanding exposure to extremely high pressures without damage, the system is designed so that the internal pressure therein never exceeds a predetermined maximum value. The recess 175 is designed so that after a volume equal to that necessary to cause the internal pressure to reach the predetermined value has been displaced into the bellows chamber, the diaphragm 177 will uniformly contact the walls of the recess 175 permitting no further volume displacement and hence no further increase in internal pressure. It should be noted that the bellows 198 and spring 199 must be such that the volume of the recess 175 may be completely displaced therein.

From the foregoing it is thought that the operation and construction of the device will be readily understood. However, recapitulating briefly it is deemed apparent that the hydraulic system balances out the static head, and also discriminates against low frequency pressure variation due to tidal inaction, and also discriminates against the higher frequency pressure variations such as would be caused by countermining explosions. Further, the hydraulic system prevents the application of pressure in excess of a predetermined maximum, so as to thereby prevent damage to the bellows and spring.

Since an ion concentration gradient is maintained between the chambers and the electrolytic pressure sensitive device, the latter is responsible only to negative pressure signals which cause the electrolyte in the chamber of high $I_3^-$ ion concentration to flow past the cathode orifice into the chamber of low $I_3^-$ ion concentration. Positive pressure signals which cause fluid flow from the chamber of high $I_1^-$ ion concentration to flow into the chamber of high $I_3^-$ ion concentration, produce negligible current flow through the circuit including the cathode orifice. By proper design of the cathode orifices, the output current thereof is made proportional to the square root of the negative pressure differential existing across the system whereby the current flow through the integrator cells is proportional to the time integral of the square root of the negative pressure signals. Since the time interval of the square root of the negative pressure differential due to the passing of a vessel within a predetermined distance of the mine is the same for dimensional congruent ships, independent of the speed of the ship, it is deemed apparent that the mine firing apparatus is designed so as to be actuated only when a vessel of predetermined size passes within a predetermined range of a mine. In this manner the inherent intelligence of the pressure sensitive device is made high, whereby the device is highly resistant to conventional countermine measures.

In order to prevent actuation of the pressure sensitive mine firing apparatus due to wave action, an average integrator cell is provided which produces an output current correlative with the magnitude of the background waves. The current flow through the individual integrator cell which is correlative with the time integral of the square root of the individual negative pressure differentials is compared in a differential relay with the current through the average integrator cell which is correlative with the average of the pressure differentials applied to the system, whereby firing of the mine is effective only when the individual integral exceeds the average integral by a predetermined amount.

Because of the time delay in the diffusion of the ions from the anode within the integrator cells to the cathode, it is essential that the spacing of the electrodes be made small as practical so that the time delay between the occurrence of the pressure signals and the equilibrium $I_3^-$ concentration of the cells is not large. This is essential since firing of the mine must be effected while the vessel is still within the damage radius of the mine. Obviously, if the time delay were large, the vessel could have passed from the damage radius of the mine before the firing of the latter is effected.

It is further deemed apparent that the operation of the device illustrated in FIGS. 1 and 2 is substantially the same, the primary difference being that in FIG. 2 one cathode orifice is eliminated, and the ions which are transferred from the individual cell cathode orifice to the individual cell are swept out after the end of the negative pressure period and added to the average integrator cell.

Since the ion concentration, and consequently the current flow through the average integrator cell increases as the level of the background waves increases, and since each of the individual negative pressure signals is compared with this average, it is deemed apparent that the sensitivity of the pressure sensitive device is made an inverse function of the background conditions, whereby the device is highly resistant to premature firing due to wave action.

Obviously, the pressure sensitive device may be used in other applications than in the mine firing apparatus disclosed. Further, the function current output versus applied pressure may be made to be any of a range of values by proper design of the cathode orifice.

Whereas specific embodiments of the invention have been illustrated, it is obvious that many modifications and variations of the present invention are possible in the light of the above teachings. It is therefore to be understood that within the scope of the appended claims, the invention may be practiced otherwise than as specifically described.

What is claimed as new and desired to be secured by Letters Patent of the United States is:

1. A vessel detecting apparatus comprising means responsive to the time varying negative pressure signal produced by the passage of a vessel in proximity to the detecting apparatus for producing an electrical signal having a time varying amplitude correlative with the square root of pressure signal, means for integrating said electrical signal over the interval of the negative pressure signal duration, and ulitization means responsive to the time integral of said electrical signal.

2. An apparatus for detecting a time varying negative pressure signal comprising means for producing an electrical signal having a time varying amplitude correlative with the square root of the pressure signals applied to the apparatus, an electrolytic cell, means for increasing the ion concentration of the cell at a rate correlative with said electrical signal, means for detecting the change in conductivity of the cell, means for reducing the ion concentration in the cell at a rate such that the ion concentration in the cell varies during negative pressure periods in accordance with the time integral of the electrical signal and utilization means responsive to a predetermined ion concentration in the cell.

3. An apparatus for detecting a time varying negative pressure signal comprising a first and a second electrolytic integrator cell, means for increasing the ion concentration of said cells at a rate correlative with the time varying amplitude of the pressure signals applied to the apparatus, means including a sweep electrode for reducing the ion concentration of said first integrator cell, means for rendering said last mentioned means inoperative during the negative pressure periods of the applied pressure signals, means including a sweep electrode in said second integrator cell for reducing the ion concentration of said second integrator cell, said second integrator cell having a relatively greater volume than said first integrator cell and a relatively smaller sweep electrode whereby the incremental change in ion concentration in said second cell during each negative pressure period is small as compared to the total ion concentration of the second cell, means for producing an electrical signal correlative with the conductivity of the first integrator cell, means responsive to the conductivity of the second integrator cell for producing an output signal correlative therewith, and utilization means responsive to a predetermined amplitude relation between said electrical signal and said output signal.

4. An apparatus for detecting the time varying negative pressure signal produced by the passage of a vessel in proximity to the apparatus comprising a first and a second electrolytic integrator cell, means for increasing the ion concentration of said cells at a rate correlative with the time varying amplitude of the pressure signals applied to the apparatus, means including a sweep electrode for reducing the ion concentration of said first integrator cell at a rate such that the ion concentration in the cell varies during negative pressure periods in accordance with the time integral of the negative pressure signals, means for rendering said last mentioned means inoperative during the negative pressure periods of the applied pressure signals, means including a sweep electrode in said second integrator cell for reducing the ion concentration of said second integrator cell at a rate such that the ion concentration of said second integrator cell is correlative with the average of the pressure signals applied to the apparatus, said second integrator cell having a relatively greater volume than said first integrator cell and a relatively smaller sweep electrode whereby the incremental change in ion concentration in the second cell during each negative pressure period is small as compared to the total concentration of the second cell, means for producing an electrical signal correlative with the conductivity of the first integrator cell, means for producing an electrical signal correlative with the conductivity of the second integrator cell, a differential relay, and means for applying said electrical signals to the differential relay whereby operation thereof is effected only when the time integral of the individual negative pressure signal exceeds the average negative pressure signals by a predetermined amount.

5. The combination of claim 4 wherein said last mentioned means includes negative temperature coefficient resistors whereby changes in conductivity of the cells due to temperature changes do not affect the operation of the relay.

6. An electrolytic pressure sensitive device comprising an electrolytic cell including two separate chambers, means for maintaining an ion concentration gradient between said chambers, means communicating said chambers, pressure sensitive means for causing the electrolyte in one chamber to flow through said communicating means into the other chamber, an electrode in said communicating means adapted to contact the electrolyte passing therethrough, means including said electrode for producing an electrical signal correlative with the quantity of electrolyte flowing past said electrode and the ion concentration of the electrolyte, a second electrolytic cell, means responsive to said electrical signal for increasing the ion concentration of said second cell in proportion to said electrical signal, and means for detecting the change in conductivity of the electrolyte in said second cell in response to the change in ion concentration.

7. An electrolytic pressure sensitive device comprising an electrolytic cell including two separate chambers, means for maintaining an ion concentration gradient between said chambers, means communicating said chambers, pressure sensitive means for causing the electrolyte in one chamber to flow through said communicating means into the other chamber, an electrode in said communicating means adapted to contact the electrolyte passing therethrough, means including said electrode for producing an electrical signal correlative with the quantity of electrolyte flowing past said electrode and the ion concentration of the electrolyte, a second electrolytic cell, means responsive to said electrical signal for increasing the ion concentration of said second cell in proportion to said electrical signal, means for detecting the change in conductivity of the electrolyte in said second cell in response to the change in the ion concentration of the second cell, means for reducing the ion concentration of said second cell, and means for rendering said last mentioned means inoperative for the duration of said electrical signal.

8. An electrolytic pressure sensitive device comprising an electrolytic cell including two separate chambers, means for maintaining an ion concentration gradient between said chambers, means communicating said chambers, pressure sensitive means for causing electrolyte in one chamber to flow into the other chamber through said communicating means, a first and a second electrolytic integrator cell, means responsive to the flow of electrolyte through said communicating means for increasing the ion concentration in said first and second integrator cells at a rate correlative with the rate of flow through said communicating means, means including a sweep electrode for reducing the ion concentration of said first integrator cell, means for rendering said last mentioned means inoperative during the negative pressure periods of the applied pressure signals, means including a sweep electrode in said second integrator cell for reducing the ion concentration of said second integrator cell, said second integrator cell having a relatively greater volume than said first integrator cell and a relatively smaller sweep electrode whereby the incremental change in ion concentration during each negative pressure period is small as compared to the total concentration means for producing an electrical signal correlative with the conductivity of the first integrator cell, means responsive to the conductivity of the second integrator cell for producing an output signal correlative therewith, and utilization means responsive to a predetermined amplitude relative between said electrical signal and said output signal.

9. The combination of claim 8 wherein said ion concentration gradient producing means includes a porous filter communicating said chambers, an electrode in each of said chambers adjacent said filter and means for biasing said electrodes.

10. The combination of claim 8 wherein said means for increasing the ion concentration of said integrator cells includes an electrode in said communicating means.

11. An electrolytic pressure sensitive device comprising an electrolytic cell including first and second separate chambers, means for maintaining an ion concentration gradient between said chambers, means including an orifice electrode communicating said chambers, pressure sensitive means for causing electrolyte from one chamber to flow through said orifice electrode into the other chamber, an electrolytic integrator cell communicating with said first chamber, means including an orifice electrode communicating said chambers, pressure sensitive means for causing electrolyte from one chamber to flow through said orifice electrode into the other chamber, an electrolytic integrator cell communicating with said first chamber, said integrator cell including an anode, a sweep electrode and a perforate cathode effectively shielding said integrator cell from said first chamber, circuit means including a source of electrical potential connecting said orifice electrode and said anode for causing a current flow through said circuit means in response to the flow of electrolyte past said orifice electrode to thereby increase the ion concentration in said integrator cell, a second integrator cell having a larger volume than said first integrator cell communicating with said first chamber and including an anode, a sweep electrode and a perforate cathode shielding said second cell from said first chamber, a second circuit means including a source of electrical potential connecting the sweep electrode of the first integrator cell to the anode of the second integrator cell to thereby decrease the ion concentration of said first integrator cell and increase the ion concentration of the second integrator cell, means responsive to said integrator cell including an anode, a sweep electrode and a perforate cathode effectively shielding said integrator cell for said first chamber, circuit means including a source of electrical potential connecting said orifice electrode and said anode for causing a current flow through said circuit means in response to the flow of electrolyte past said orifice electrode to thereby increase the ion concentration in said integrator cell, sweep means including said sweep electrode for removing ions from said integrator cell, means responsive to the flow of current through said circuit means for rendering said sweep means inoperative, and means including the anode and cathode in said integrator cell for detecting the change in conductivity thereof.

12. The combination of claim 11 wherein said last mentioned means includes a negative temperature coefficient resistor for compensating for the change in conductivity of said electrolytic integrator cell in response to temperature variations.

13. An electrolytic pressure sensitive device comprising an electrolytic cell including first and second separate chambers, means for maintaining an ion concentration gradient between said chambers, means including an orifice electrode communicating said chambers, pressure sensitive means for causing electrolyte from one chamber to flow through said orifice electrode into the other chamber, an electrolytic integrator cell communicating with said first chamber, means including an orifice electrode communicating said chambers, pressure sensitive means for causing electrolyte from one chamber to flow through said orifice electrode into the other chamber, an electrolytic integrator cell communicating with said first chamber, said integrator cell including an anode, a sweep electrode and a perforate cathode effectively shielding said integrator cell from said first chamber, circuit means including a source of electrical potential connecting said orifice electrode and said anode for causing a current flow through said circuit means in response to the flow of electrolyte past said orifice electrode to thereby increase the ion concentration in said integrator cell, a second integrator cell having a larger volume than said first integrator cell communicating with said first chamber and including an anode, a sweep electrode and a perforate cathode shielding said second cell from said first chamber, a second circuit means including a source of electrical potential connecting the sweep electrode of the first integrator cell to the anode of the second integrator cell to thereby decrease the ion concentration of said first integrator cell and increase the ion concentration of the second integrator cell, means responsive to said integrator cell including an anode, a sweep electrode and a perforate cathode effectively shielding said integrator cell for said first chamber, circuit means including a source of electrical potential connecting said orifice electrode and said anode for causing a current flow through said circuit means in response to the flow of electrolyte past said orifice electrode to thereby increase the ion concentration in said integrator cell, a second integrator cell having a larger volume than said first integrator cell communicating with said first chamber and including an anode, a sweep electrode and a perforate cathode shielding said second cell from said first chamber, a second circuit means including a source of electrical potential connecting the sweep electrode of the first integrator cell to the anode of the second integrator cell to thereby decrease the ion concentration of said first integrator cell and increase the ion concentration of the second integrator cell, means responsive to current flow in said first circuit means for rendering second circuit means inoperative, means including the anode and cathode in said first integrator cell for producing an output current correlative with the conductivity of the first cell, means including the anode and cathode in said second integrator cell for producing an output current correlative the conductivity of the second cell, and utilization means responsive to a predetermined differential between said output currents.

14. An electrolytic pressure sensitive device comprising an electrolytic cell including first and second separate chambers, means for maintaining an ion concentration gradient between said chambers, means including first and second orifice electrodes communicating said chambers, pressure sensitive means for causing the electrolyte in one chamber to flow through said orifice electrodes into the other chamber, a first and a second electrolytic integrator cell communicating with said first chamber, said integrator cells each including an anode, a sweep electrode and a perforate cathode, said cathodes being constructed and arranged to shield the respective integrator cells from the first chamber, a first circuit means including a source of electrical potential connecting said first orifice electrode to the first cell anode, a second circuit means including a source of potential connecting said second orifice electrode to the second cell anode, first and second sweep means respectively including the sweep electrodes in the first and second cells for reducing the ion concentration in said cells, means responsive to current flow in said first circuit means for rendering said first sweep means inoperative, and means including the anode and cathode in each said first and second cell for detecting changes in the ion concentration of said first and second cells.

15. An electrolytic pressure sensitive device comprising an electrolytic cell including first and second separate chambers, means for maintaining an ion concentration gradient between said chambers, means including first and second orifice electrodes communicating said chambers, pressure sensitive means for causing the electrolyte in one chamber to flow through said orifice electrodes into the other chamber, a first and a second electrolytic integrator cell communicating with said first chamber, said integrator cells each including an anode, a sweep electrode and a perforate cathode, said cathodes being constructed and arranged to shield the respective integrator cells from the first chamber, a first circuit means including a source of electrical potential connecting said first orifice electrode to the first cell anode, a second circuit means including a source of potential connecting said second orifice electrode to the second cell anode, first and second sweep means respectively including the sweep electrodes in the first and second cells for reducing the ion concentration in said cells, means responsive to current flow in said first circuit means for rendering said first sweep means inoperative, means including the anode and cathode in said first integrator cell for producing an output current correlative with the conductivity of the first cell, means including the anode and cathode in said second integrator cell for producing an output current correlative the conductivity of the second cell, and utilization means responsive to a predetermined differential between said output currents.

16. An electrolytic pressure sensitive device comprising an electrolytic cell including first and second separate chambers, means for maintaining an ion concentration gradient between said chambers, means including first and second orifice electrodes communicating said chambers, pressure sensitive means for causing the electrolyte in one chamber to flow through said orifice electrodes into the other chamber, a first and a second electrolytic integrator cell communicating with said first chamber, said integrator cells each including an anode, a sweep electrode and a perforate cathode, said cathodes being constructed and arranged to shield the respective integrator cells from the first chamber, a first circuit means including a source of electrical potential connecting said first orifice electrode to the first cell anode, a second circuit means including a source of potential connecting said second orifice electrode to the second cell anode, first and second sweep means respectively including the sweep electrodes in the first and second cells for reducing the ion concentration in said cells, means responsive to current flow in said first circuit means for rendering said first sweep means inoperative, means including the anode and cathode in each said first and second cell for detecting changes in the ion concentration thereof, a second utilization means responsive to a predetermined differential between the current from the second cell orifice cathode to the second cell anode and the second cell output current.

17. A signal detecting apparatus comprising means for producing an electrical signal having a time varying amplitude correlative with the applied signal, an electrolytic cell, means responsive to said electrical signal for introducing ions into said cell at a rate proportional to said electrical signal, means in said cell for measuring the change in conductivity thereof in response to variations in ion concentration, means in said cell for reducing the ion concentration therein, and means responsive to said electrical signal for rendering said last named means inoperative for the duration of said electrical signal, said concentration reducing means including means for removing ions from said cell and means for rendering said ion removing means inoperative during the negative pressure periods of the applied pressure signal.

18. A signal detecting apparatus comprising means for producing an electrical signal having a time varying amplitude correlative with the applied signal, an electrolytic cell, means responsive to said electrical signal for introducing ions into said cell at a rate proportional to said electrical signal, means in said cell for measuring the change in conductivity thereof in response to variations in ion concentration, means including ion removing means in said cell for reducing the ion concentration therein, and means responsive to said electrical signal for rendering said last named means inoperative for the duration of said electrical signal, said ion removing means including a sweep electrode in said cell.

* * * * *